US009993094B1

(12) United States Patent
Franzone, Jr. et al.

(10) Patent No.: US 9,993,094 B1
(45) Date of Patent: Jun. 12, 2018

(54) ROTARY DISPLAY HOOK

(71) Applicant: ALLEN FIELD COMPANY, INC., Brightwaters, NY (US)

(72) Inventors: Andrew Franzone, Jr., Bay Shore, NY (US); Robert Ahearn, Massapequa, NY (US); Eric Seger, Wantagh, NY (US)

(73) Assignee: ALLEN FIELD COMPANY, INC., Brightwaters, NY (US)

( * ) Notice: Subject to any disclaimer, the term of this patent is extended or adjusted under 35 U.S.C. 154(b) by 0 days. days.

(21) Appl. No.: 15/696,407

(22) Filed: Sep. 6, 2017

(51) Int. Cl.
*A47F 5/08* (2006.01)
*A47F 5/00* (2006.01)

(52) U.S. Cl.
CPC ..... *A47F 5/0815* (2013.01); *A47F 5/0006* (2013.01)

(58) Field of Classification Search
CPC ... F16B 45/00; F16M 13/02; B29L 2031/738; A47F 5/0815; A47F 5/0006
USPC ..... 248/220.21, 220.22, 220.31, 304, 215, 248/691, 497, 211, 213, 225.21, 234, 248/290.1, 294.1, 303, 322, 339; 211/106.01; 40/642.01, 667
See application file for complete search history.

(56) References Cited

U.S. PATENT DOCUMENTS

| | | | | |
|---|---|---|---|---|
| 4,860,905 | A * | 8/1989 | Schott | A47F 5/0823 211/59.1 |
| 5,233,731 | A * | 8/1993 | Phillips | B60R 13/0206 24/297 |
| 5,611,438 | A * | 3/1997 | Dye | A47F 5/0823 211/57.1 |
| 5,647,566 | A * | 7/1997 | Kump | A47F 5/0823 248/220.21 |
| 6,234,436 | B1 * | 5/2001 | Kump | A47F 5/0823 211/59.1 |
| 6,769,656 | B1 * | 8/2004 | Botkin | A47F 5/0823 211/57.1 |
| 2007/0102378 | A1 * | 5/2007 | Innis | A47F 5/0853 211/59.1 |
| 2016/0053802 | A1 * | 2/2016 | Wang | F16B 47/00 248/205.8 |
| 2018/0023759 | A1 * | 1/2018 | Stender | F16M 13/02 |

* cited by examiner

*Primary Examiner* — Muhammad Ijaz
(74) *Attorney, Agent, or Firm* — Epstein Drangel LLP; Robert L. Epstein

(57) ABSTRACT

A hook is provided for a merchandise display including a support wall having an opening. The hook includes a base. The base includes a first wall and a second wall. The base walls are substantially parallel to each other and spaced from each other by a distance at least as great as the thickness of the support wall. The hook extends from the first wall and is adapted to retain one or more merchandise items. The first wall has a central portion and oppositely directed, substantially coplanar sections extending from the central portion. The first wall is adapted to be inserted through the support wall opening from behind the support wall such that the support wall is situated between the first wall and the second wall. The hook is then rotated relative to the support wall to secure the base of the hook to the support wall.

15 Claims, 3 Drawing Sheets

ROTARY DISPLAY HOOK

BACKGROUND OF THE INVENTION

1. Field of the Invention

The present invention relates to merchandise displays and more particularly to a hook for a merchandise display adapted for use with a support wall of the display having an opening wherein the hook may be inserted through the support wall opening and rotated to secure the hook to the support wall.

2. Description of Prior Art Including Information Disclosed Under 37 CFR 1.97 and 1.98

Merchandise displays commonly include a vertical support such as a wall and one or more hooks or rods which extend outwardly from the front surface of the support wall. One or more merchandise items can be suspended from the hook so that the items on display can be viewed by potential customers and easily removed from the display by the customer for purchase.

Commonly, the hooks are mounted on the support from the front of the support wall. For this purpose, small holes in the front surface of the support wall may be provided to receive protrusions from the rear of each hook. In some cases, the rear portion of the hook may be deformed by squeezing to allow the protrusions to line up correctly with the support wall holes. In those cases, once inserted, the protrusions may apply some pressure against the sides of the holes, as the squeezing force is released to increase the frictional engagement between the hook and support wall.

However, this conventional mounting has not proved to be sufficiently secure. As a result, the hook may become accidentally detached from the support as a merchandise item is removed from the display. Further, the mounting process may be difficult.

BRIEF SUMMARY OF THE INVENTION

The above disadvantages of conventional merchandise display hooks are overcome by the present invention which utilizes a "bayonet-type" mounting configuration in which the hook is inserted through an enlarged opening in the support wall from the rear and then rotated relative to the support wall to secure the hook to the support wall.

In accordance with one aspect of the present invention, a hook is provided for a merchandise display including a support wall of a given thickness having an opening. The hook includes a base. The base includes a first wall and a second wall. The first wall and the second wall are substantially parallel to each other and spaced from each other by a distance at least as great as the thickness of the support wall. The hook extends from the first wall and is adapted to retain one or more merchandise items. The first wall has a central portion and oppositely directed, substantially coplanar sections extending from the central portion. The first wall is adapted to be inserted through the support wall opening from behind the support wall such that the support wall is situated between the first wall and the second wall. The hook is then rotated relative to the support wall to secure the base of the hook to the support wall.

Preferably, the central portion of the first wall is round and has a given diameter. The second wall includes a portion which is larger than the diameter of the central portion of the first wall such that the second wall cannot fit through the opening in the support wall.

The second wall may include first and second openings substantially aligned with the extended sections of the first wall, respectively.

Preferably, the second wall is substantially circular.

Preferably, the base further includes a central recess. The central recess of the base is open at the second wall.

A wall section is provided traversing the central recess to facilitate the rotation of the hook relative to the support.

In accordance with another aspect of the present invention, a merchandise display is provided including a support wall and a hook for retaining one or more merchandise items on the support wall. The support has a given thickness and an opening. The hook includes a base. The base has a first wall and a second wall. The first wall and the second wall are substantially parallel to each other and spaced from each other by a distance at least as great as the thickness of the support wall. The hook extends from the first wall of the base. The first wall has a central portion and oppositely directed, substantially coplanar sections extending from the central portion. The support wall opening has a size and shape similar to that of the first wall of the base such that the first wall can be inserted through the support wall opening from behind the support wall such that the support wall is situated between the first wall and the second wall. The hook may then be rotated relative to the support wall to secure the base to the support wall.

Preferably, the central portion of the first wall is round and has a given diameter. The second wall includes a portion which is larger than the diameter of the central portion of the first wall such that the second wall cannot fit through the opening in the support wall.

The second wall may include first and second openings substantially aligned with the extended sections of the first wall, respectively.

Preferably, the second wall is substantially circular.

Preferably, the base further includes a central recess. The central recess is open at the second wall.

A wall section is provided traversing the central recess to facilitate the rotation of the hook relative to the support.

In accordance with another aspect of the present invention, a method is provided for mounting a hook on a merchandise display support of the type having a given thickness and an opening. The hook includes a base with first and second substantially parallel walls, spaced from each other by a distance at least as great as the thickness of the support. The hook extends from the first wall of the base and is adapted to retain one or more merchandise items. The first wall includes a central portion and oppositely directed, substantially coplanar sections extending from the central portion. The support opening has a size and shape substantially the same as the size and shape of the first wall. The method includes the steps of inserting the first wall through the support opening from behind such that the support is situated between the first wall and the second wall; and then rotating the hook relative to the support to secure the base to the support.

BRIEF DESCRIPTION OF THE SEVERAL VIEWS OF DRAWINGS

To these and to such other objects that may hereinafter appear, the present invention relates to a hook for a merchandize display as described in detail in the following specification and recited in the annexed claims, taken together with the accompanying drawings, in which like numerals refer to like parts and in which:

DETAILED DESCRIPTION OF THE INVENTION

Figure 1:
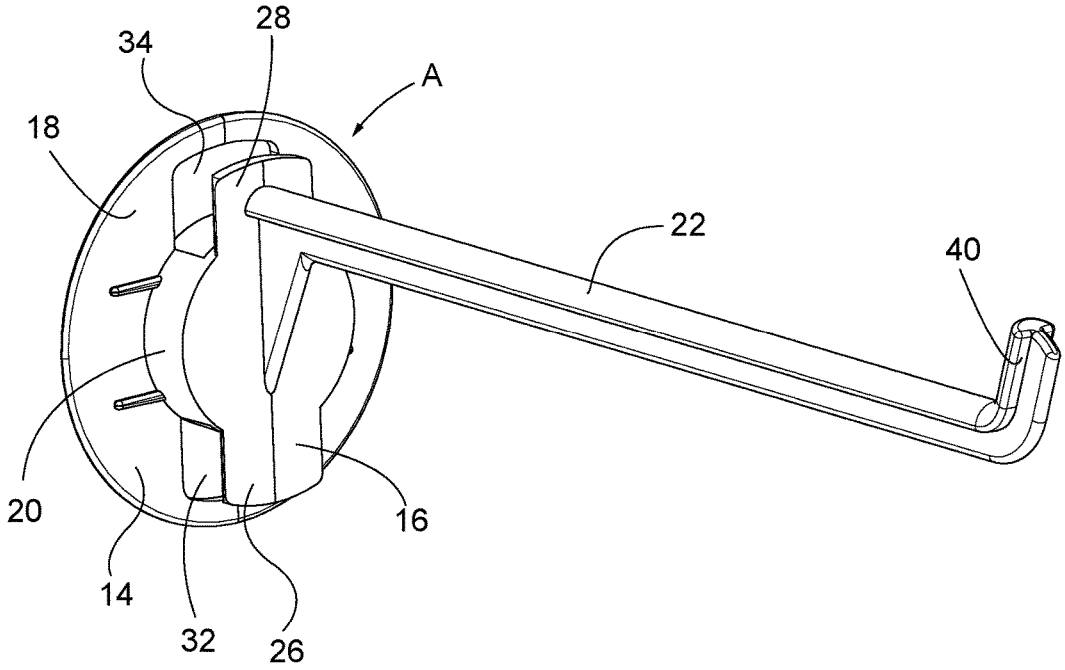
FIG. 1 is a front perspective view of the merchandise display hook of the present invention.

As depicted in the drawings, the present invention relates to a hook, generally designated A, designed for use as part of a merchandise display including a support, generally designated B, including a vertical support wall 10. Wall 10 has a front surface 10*a* and a rear surface 10*b*. Hook A is mounted to wall 10 and extends outwardly from front surface 10*a* of the wall. Wall 10 has a given thickness. Wall 10 also has an opening 12. The hook is mounted to the support wall from the rear of the wall by inserting the hook through opening 12. Hook A is adapted to retain one or more merchandise items on the support in front of the support wall.

Figure 2:
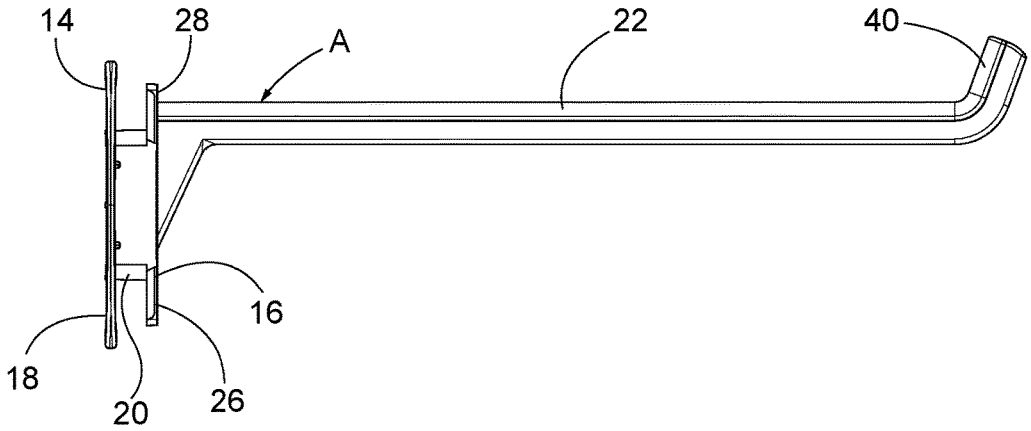
FIG. 2 is a side elevation view of the hook.
Figure 3:
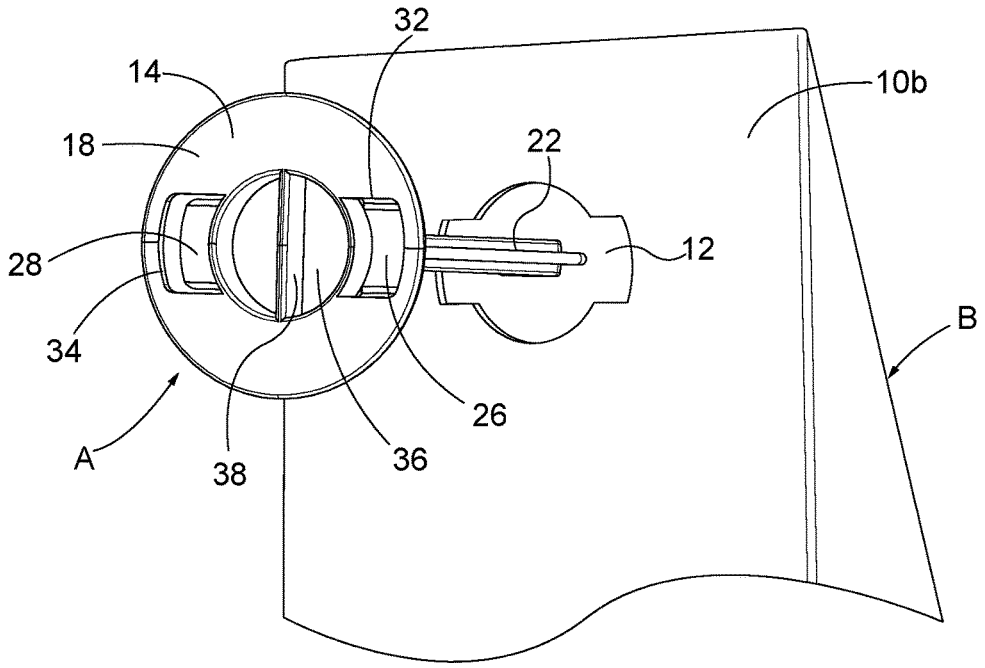
FIG. 3 is a rear perspective view of the hook and of the support showing the hook as it is being inserted into the support opening from the rear of the support.
Figure 4:
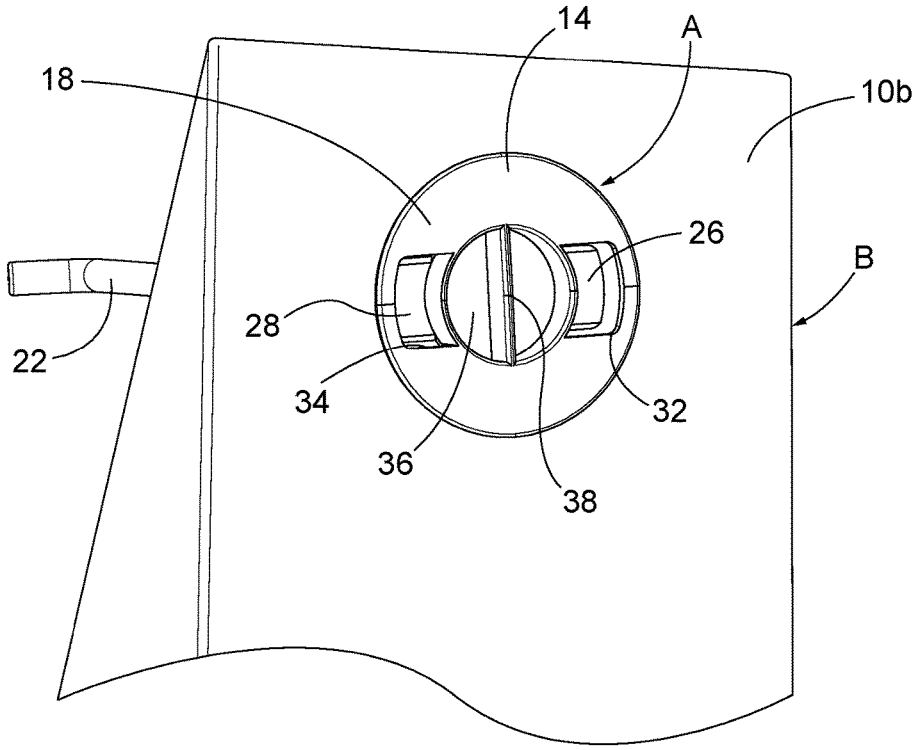
FIG. 4 is a rear view of the support after the hook has been inserted into the support opening, but before the hook is rotated relative to the support.
Figure 5:
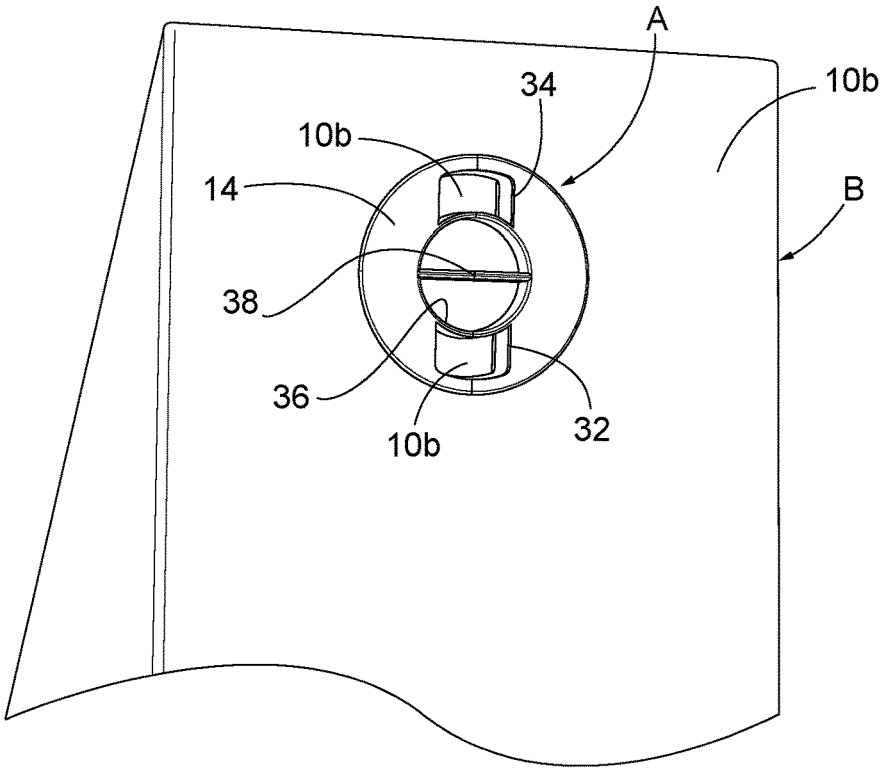
FIG. 5 is a view similar to that of FIG. 4, but shows the hook after it has been rotated relative to the support.
Figure 6:
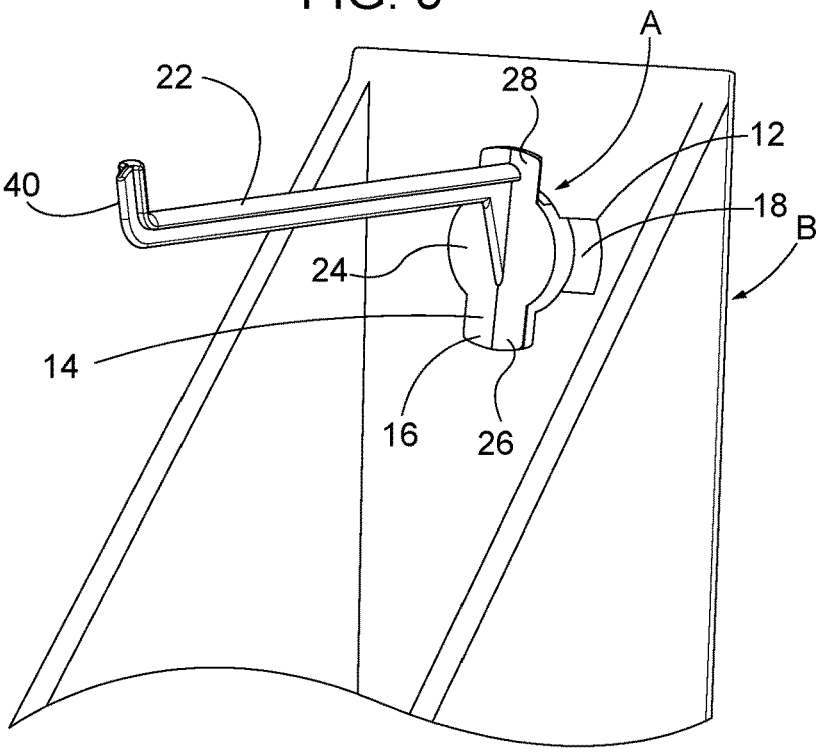
FIG. 6 is a front perspective view of the hook and the support after the hook is secured to the support.

The hook includes a base 14. Base 14 has a front wall 16 and a rear wall 18. Front wall 16 and rear wall 18 are substantially parallel to each other. Walls 16 and 18 are spaced from each other along a cylindrical body 20. The walls are separated by a distance at least as great as the thickness of the support wall, as best seen in FIG. 2.

The hook also includes a rod 22. Rod 22 extends from the front wall 16 and functions to support one or more items of merchandise.

As best seen in FIG. 1, front wall 16 has a generally circular central portion 24. It also has oppositely directed, substantially coplanar sections 26, 28 extending from the central portion.

Wall opening 12 has a shape similar to that of the front wall such that the front wall can be inserted through opening 12 from behind the support wall. Once inserted, the front wall 16 will be in front of front surface 10*a* of wall 10 and the rear wall 18 will be behind rear surface 10*b* of wall 10 such that the wall is aligned with body 20. In that position, the hook can be rotated relative to the support wall to secure the base to the support.

The central portion 24 of the front wall 16 has a given diameter. The rear wall 18 includes a portion which is larger than the diameter of the central portion of the front wall 16 such that the rear wall cannot fit through opening 12 in wall 10 of the support. This prevents the base 14 from being pulled all the way through the opening in the support wall. In the preferred embodiment illustrated in the drawings, rear wall 18 is circular and has a substantially greater diameter than the central portion 24 of the front wall 16.

The rear wall 18 may include openings 32, 34 which align with sections 26, 28, respectively, of the front wall 16. Further, body 20 may include a recess 36 which is open at the rear of the base. A wall section 38 extends across recess 36 such that the user can insert his or her fingers into the base to rotate the hook relative to the support wall.

In use, hook A is inserted from the rear of support wall 10 through opening 12 as far as possible such the front wall of the base passes through opening 12 until the rear wall 18 is adjacent the rear surface of the support wall. In that position, the support wall is aligned with body 20 of the base. The hook is then rotated relative to the support wall ninety degrees to secure the hook on the support wall. Once mounted, one or more items of merchandise can be suspended from rod 22 for display purposes. Preferably, the end 40 of rod 22 is bent upwardly such that the merchandise items supported by the hook cannot accidentally fall of the hook.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

We claim:

1. A hook for a merchandise display including a support wall of a thickness having an opening:

said hook comprising a base, said base comprising a first wall and a second wall, said first wall and said second wall being substantially parallel to each other and spaced from each other by a distance greater than said thickness of the support wall, said hook extending from said first wall and being adapted to retain one or more merchandise items, said first wall comprising a central portion and oppositely directed, substantially coplanar sections extending from said central portion, said second wall comprising first and second opening substantially aligned with said extended sections of said first wall, respectively, said first wall being adapted to be inserted through the support wall opening from behind to align the support wall between said first wall and said second wall, such that said hook is configured to rotate relative to the support wall to secure said base to the support.

2. The hook of claim 1 wherein said central portion of said first wall is round and has a given diameter.

3. The hook of claim 2 wherein said second wall comprises a portion which is larger than the diameter of said central portion of said first wall.

4. The hook of claim 1 wherein said second wall is substantially circular.

5. The hook of claim 1 wherein said base has a central recess.

6. The hook of claim 5 wherein said central recess is open at said second wall.

7. The hook of claim 5 further comprising a wall section traversing said recess.

8. A merchandise display comprising a support wall with an opening and a hook for retaining one or more merchandise items on said support wall:

said support wall having a thickness, said hook comprising a base, said base, comprising a first wall and a second wall, said first wall and said second wall being substantially parallel to each other and spaced from each other by a distance greater than said thickness of said support all, said hook extending from said first wall, said first wall comprising a central portion and oppositely directed substantially coplanar sections extending from said central portion, said second wall comprises first and second opening substantially aligned with said extended sections of said first wall, respectively, said support wall opening having a size and shape substantially the same as the size and shape of said first wall such that said first all ma be inserted through said support wall opening from behind to align said support Wall between said first wall and said second wall, such that said hook is configured to rotate relative to said support wall to secure said base to said support.

9. The display of claim 8 wherein said central portion of said first wall is round and has a given diameter.

10. The display of claim 8 wherein said second wall comprises a portion which is larger than the diameter of said central portion of said first wall.

11. The display of claim 8 wherein said second wall is substantially circular.

12. The display of claim 8 wherein said second wall further comprises a recess.

13. The display of claim 12 wherein said recess is open at said second wall.

14. The display of claim 8 wherein said base comprises a recess portion and further comprising a wall section traversing said recess.

15. A Method for mounting a hook on a merchandise display support of the type having a thickness and an opening, the hook including a base with first and second substantially parallel walls, spaced from each other by a distance greater than the thickness of the support, the hook extending from the first wall and being adapted to retain one or more merchandise items, the first wall including a central portion and oppositely directed substantially coplanar sections extending from the central portion, second wall comprises first and second opening substantially aligned with said extended sections of said first wall, respectively, and the support opening have a size and shape substantially the same as the size and shape of said first wall of said base, the method comprising the steps of:

inserting the first wall through the support opening from behind to align the support between the first wall and the second wall; and then rotating the hook relative to the support to secure the base to the support.

* * * * *